US006702462B2

(12) United States Patent
Richardson

(10) Patent No.: US 6,702,462 B2
(45) Date of Patent: Mar. 9, 2004

(54) FLEXIBLE DISPENSING PACKAGE

(75) Inventor: Tom Richardson, Fairfax, CA (US)

(73) Assignee: Cliff Barr Inc., Berkeley, CA (US)

( * ) Notice: Subject to any disclaimer, the term of this patent is extended or adjusted under 35 U.S.C. 154(b) by 0 days.

(21) Appl. No.: 09/818,083

(22) Filed: Mar. 26, 2001

(65) Prior Publication Data

US 2002/0136470 A1 Sep. 26, 2002

(51) Int. Cl.[7] ..... B65D 33/00

(52) U.S. Cl. ..... 383/200; 383/207; 383/906; 222/107; 222/541.6

(58) Field of Search ..... 383/200, 203, 383/207, 208, 77, 62, 906; 222/107, 541.6, 543; 206/530, 532

(56) References Cited

U.S. PATENT DOCUMENTS

| | | | | | |
|---|---|---|---|---|---|
| 2,103,389 | A | * | 12/1937 | Salfisberg | 383/200 X |
| RE24,251 | E | * | 12/1956 | Kaplan et al. | 383/200 X |
| 3,140,815 | A | * | 7/1964 | Majesky | 383/203 |
| 3,171,581 | A | | 3/1965 | Kugler | |
| 3,217,971 | A | * | 11/1965 | Shvetz | 383/203 |
| 3,388,836 | A | | 6/1968 | Otto et al. | |
| 3,480,198 | A | * | 11/1969 | Repko | 383/207 X |
| 4,363,406 | A | | 12/1982 | Salvadori | |
| 4,644,732 | A | | 2/1987 | Morton | |
| 4,935,283 | A | * | 6/1990 | Jamison | 383/906 X |
| 4,937,410 | A | * | 6/1990 | Anderson | 383/77 X |
| 4,974,732 | A | * | 12/1990 | Sullivan et al. | 383/906 X |
| 5,593,229 | A | | 1/1997 | Warr | |
| 5,746,352 | A | * | 5/1998 | Corella | 222/107 |
| 5,758,473 | A | | 6/1998 | Patelli | |
| 5,826,737 | A | * | 10/1998 | Zakensberg | 383/62 X |
| 6,074,097 | A | | 6/2000 | Hayashi et al. | |
| 6,095,689 | A | * | 8/2000 | Bochet | 383/906 X |
| 6,244,467 | B1 | * | 6/2001 | Lewit | 222/107 |

FOREIGN PATENT DOCUMENTS

| | | |
|---|---|---|
| JP | 64-37356 | 2/1989 |

* cited by examiner

*Primary Examiner*—Jes F. Pascua
(74) *Attorney, Agent, or Firm*—Townsend and Townsend and Crew LLP

(57) ABSTRACT

A flexible package for dispensing fluid or semi-fluid items. The package includes a top proximal portion and a bottom distal portion. A leash is defined within a side edge panel and extends from the proximal portion to the distal portion. A user tears the top proximal portion at a tear notch adjacent the proximal portion and then tears the top portion down along the leash in order to keep the top portion coupled to the package and allowing for removal of the package's contents.

5 Claims, 3 Drawing Sheets

FLEXIBLE DISPENSING PACKAGE

BACKGROUND OF THE INVENTION

1. Field of the Invention

The present invention relates to a flexible dispensing package, and more particularly, to a flexible dispensing package that includes a leash for keeping a top of the package coupled to the package itself after the top of the package has been torn away from the package.

2. Description of the Prior Art

It has long been customary to utilize various types of flexible sheet material packages for protectively packaging commodities of any types. The use of such flexible packages for liquids, gels, condiments, etc. is presently limited. Although these items may be neatly packaged in such flexible containers, difficulties are encountered with regard to proper disposal of torn off tops for the packages as well as the packages themselves.

For example, energy gels are currently a popular product that is used predominantly by serious endurance athletes during long races or training sessions. Such energy gels generally contain a large amount of carbohydrate-based calories packaged within a small package. However, such gel packets have historically had a similar design in that when opening the package, the torn-off top becomes tricky and time consuming to deal with. Unfortunately, many of tops end up being thrown onto trails or roads since athletes don't have enough hands to deal with the trash generated by the packages and the torn-off package tops.

SUMMARY OF THE INVENTION

The present invention provides a package that includes a tear notch near the proximal end and a leash defined within an edge panel of the package, the edge panel extending from the proximal end of the package to the distal end of the package and being located on the side of the package opposite the tear notch. When one tears the package at the tear notch, a portion of the package tears at the proximal end of the package. This portion of the package remains coupled to the package by the leash. Accordingly, the package may be opened but still may be kept as a one-piece item, thus helping to avoid improper disposal of pieces of the package upon opening of the package.

In accordance with one aspect of the present invention, the leash is defined by a cut within the edge panel that extends from a proximal end portion of the package to a distal end portion of the package.

In accordance with another aspect of the present invention, the leash is defined by a perforation defined within the edge panel and extends to a stop defined within the edge panel. Thus, the user may tear the package at the tear notch and then continue to tear the package along the perforation in order to move the torn-off piece of the package away from the opening of the package so as not to interfere with dispensing of the contents of the package.

In accordance with yet another aspect of the present invention, the stop comprises a weld.

In accordance with a further aspect of the present invention, the stop comprises an opening defined within the edge panel.

In accordance with yet another aspect of the present invention, the package comprises a flexible material.

In accordance with a further aspect of the present invention, the flexible material comprises a foil.

Other features and advantages of the present invention will be understood upon reading and understanding the detailed description of the preferred exemplary embodiments, found herein below, in conjunction with reference to the drawings, in which like numerals represent like elements.

DETAILED DESCRIPTION OF SPECIFIC EXEMPLARY EMBODIMENTS

Figure 1:
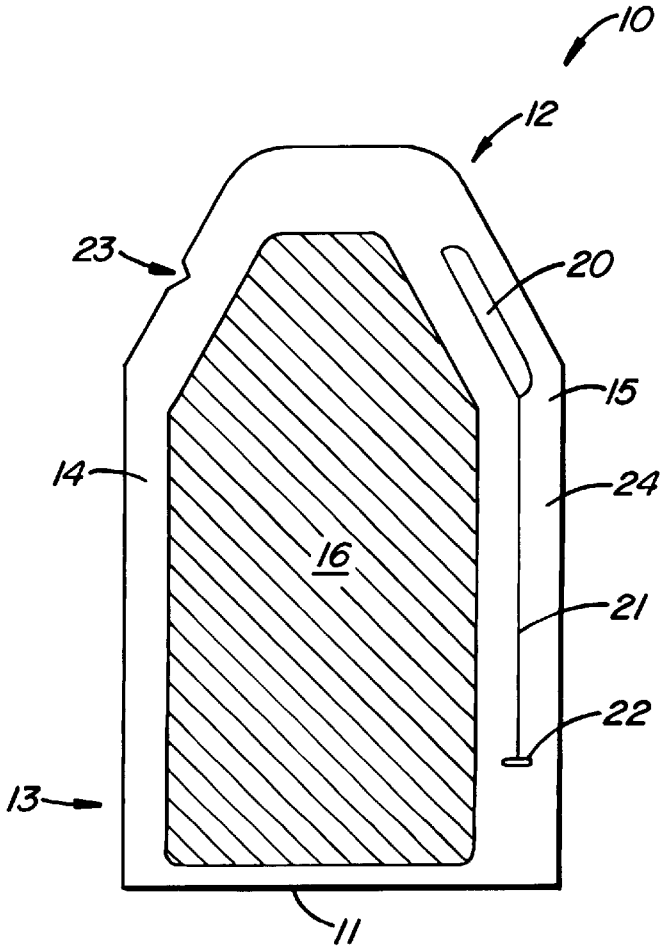
FIG. 1 is a schematic elevational view of a package in accordance with the present invention.

FIG. 1 illustrates a package 10. Package 10 includes a body 11 defined by a top proximal portion 12 and a bottom distal portion 13, as well as side edge panels 14 and 15. The top and bottom portions along with the side edge panels define a compartment 16 for holding the packages' contents.

Side edge panel 15 preferably includes a window 20 defined therein that is adjacent top proximal portion 12. Adjacent window 20 is a perforation 21. Perforation 21 extends from the window to stop 22.

Figure 2:
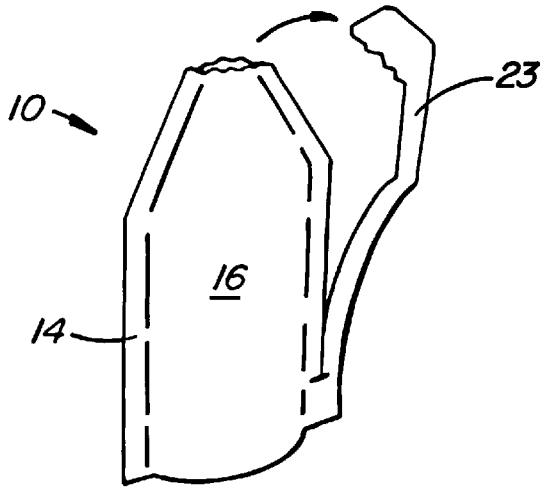
FIG. 2 is a perspective view of the package illustrated in FIG. 1 with a top of the package torn off.
Figure 3:
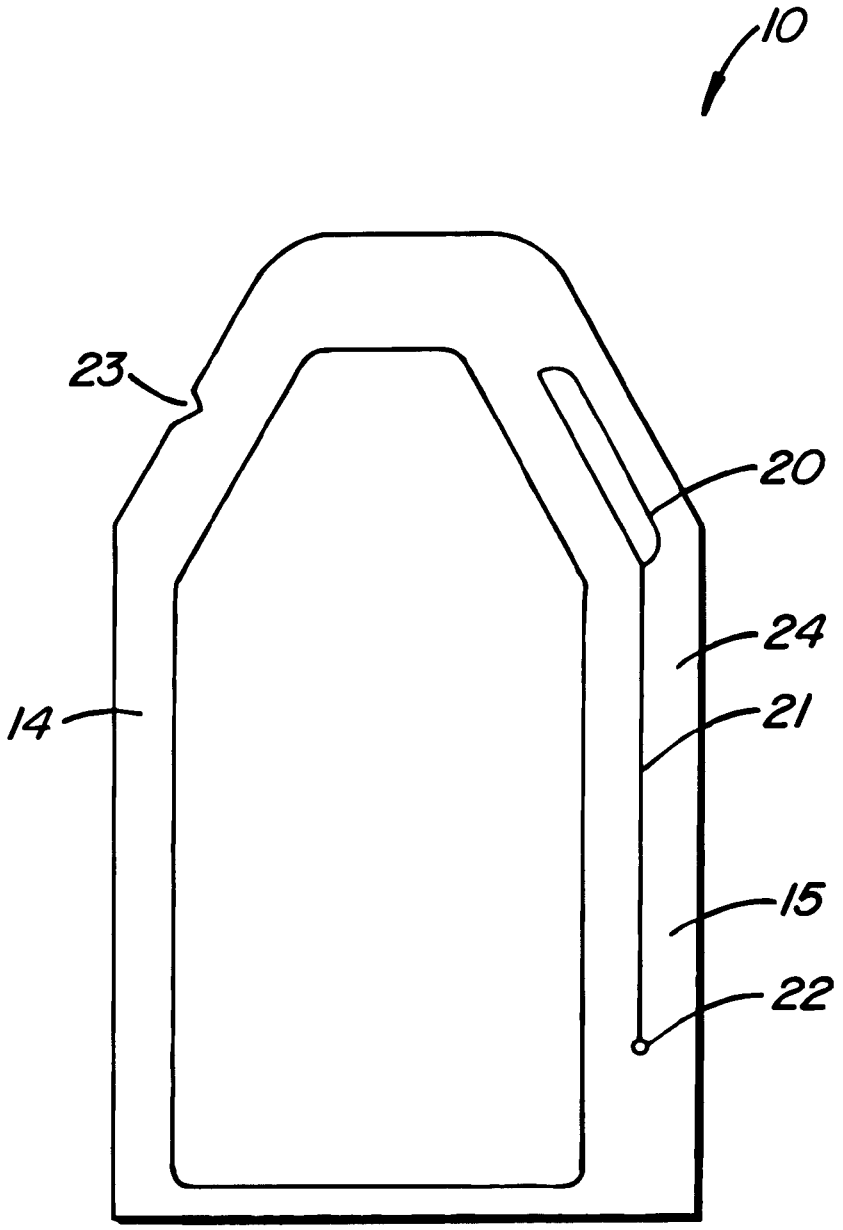
FIG. 3 is a schematic elevational view of an alternative embodiment of a package in accordance with the present invention.

Side edge panel 15 preferably includes a window 20 defined therein that is adjacent top proximal portion 12. Adjacent window 20 is a perforation 21. Perforation 21 preferably extends from the window to stop 22. Stop 22 may consist of a weld (as illustrated in FIGS. 1 and 2) or a gap (as illustrated in FIG. 3). The perforation may simply end if desired.

Figure 4:
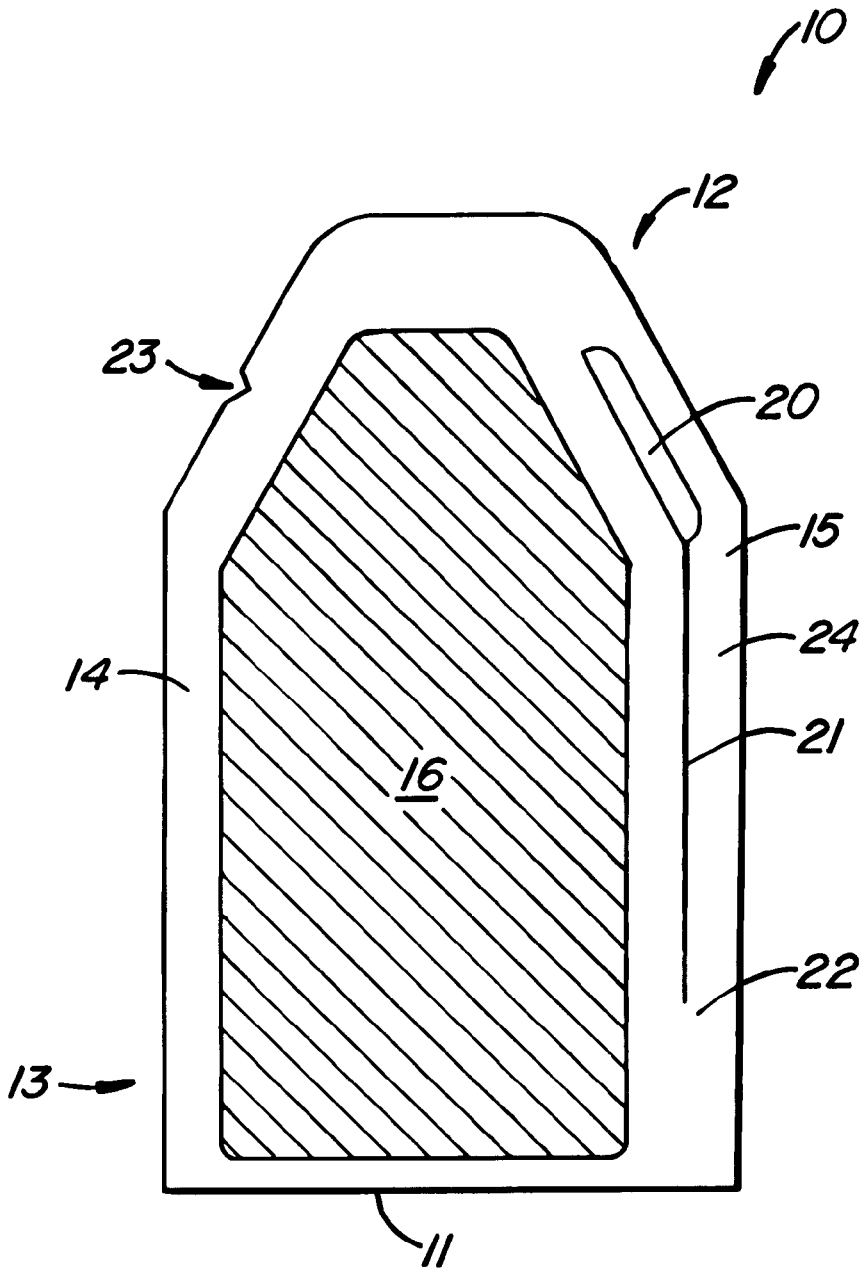
FIG. 4 is a schematic elevational view of an alternative embodiment of a package in accordance with the present invention.

Alternatively, as illustrated in FIG. 4, the perforation may be replaced with a direct cut. Thus, the litter leash is defined by the window and the direct cut and extends from proximal end portion 12 to distal end portion 13. Those skilled in the art will realize that the window may be replaced with a simple direct cut if it is so desired. A stop may or may not be provided as desired.

Side panel 14 includes a tear notch 23 defined therein. The tear notch is adjacent the top proximal portion of the package and is opposite the window.

In order to remove the contents from the package, one tears at the package at tear notch 23 tearing across the top portion of compartment 16 until window 20 is reached. The package is now open and the contents may be removed. However, a leash 24 is provided in order to move the torn top proximal portion out of the user's way. Thus, the torn proximal top portion is pulled down so that perforation 21 tears until stop 22 is reached. Accordingly, the torn proximal top portion is now out of the user's way but is still connected to the package, with leash 24, thereby aiding in undesirable disposal of the top proximal portion.

Package 10 is preferably for liquid or semi-liquid items such as, for example, juices, gels, and condiments, such as, for example, catsup, mustard, mayonnaise, etc. Accordingly, the package is preferably manufactured from a foil in a manner known in the art wherein two pieces of foil are pressed together at the side edge panels and top edge panels to define the compartment portion of the package. One piece of foil may also be used as is known in the art. The single piece of foil is folded to define the compartment portion of the package.

The tear notch may be created by cutting or punching. Likewise, the window may also be created by cutting or punching within the side panel. The perforation may be a weakened area within the side panel defined by punching or may also be a distinct cut line.

Those skilled in the art will understand that the window may be replaced with a perforation such that perforation 21 extends from the top proximal portion of the package to the stop. Those skilled in the art will also realize that packages that currently exist made from foil generally tear easily along straight lines and thus, a perforation is generally not required from the tear notch to the window.

Although the invention has been described with reference to specific exemplary embodiments, it will be appreciated that it is intended to cover all modifications and equivalents within the scope of the appended claims.

What is claimed is:

1. A package comprising:

a distal end and a proximal end;

a tear notch adjacent the proximal end; and a partially removable leash defined within an edge panel extending from the proximal end to the distal end, the edge panel being on a side of the package opposite the tear notch;

wherein the leash comprises a perforation defined within the edge panel and extending to a stop defined within the edge panel.

2. A package in accordance with claim 1 wherein the stop comprises a weld.

3. A package in accordance with claim 1 wherein the stop comprises an opening defined within the edge panel.

4. A package in accordance with claim 1 wherein the package comprises a flexible material.

5. A package in accordance with claim 4 wherein the flexible material comprises foil.

* * * * *